US012127609B2

(12) United States Patent
Trozzi

(10) Patent No.: US 12,127,609 B2
(45) Date of Patent: Oct. 29, 2024

(54) SAFE AIR HEAD, FACE, AND BODY GEAR

(71) Applicant: Nick Trozzi, Pacoima, CA (US)

(72) Inventor: Nick Trozzi, Pacoima, CA (US)

( * ) Notice: Subject to any disclaimer, the term of this patent is extended or adjusted under 35 U.S.C. 154(b) by 1204 days.

(21) Appl. No.: 15/793,066

(22) Filed: Oct. 25, 2017

(65) Prior Publication Data

US 2018/0055103 A1 Mar. 1, 2018

Related U.S. Application Data

(63) Continuation-in-part of application No. 13/815,510, filed on Mar. 7, 2013, now abandoned.

(60) Provisional application No. 61/743,156, filed on Aug. 27, 2012.

(51) Int. Cl.

| | |
|---|---|
| ***A63B 71/08*** | (2006.01) |
| ***A41D 13/015*** | (2006.01) |
| ***A41D 13/018*** | (2006.01) |
| ***A42B 3/06*** | (2006.01) |
| ***A42B 3/12*** | (2006.01) |
| ***A63B 71/10*** | (2006.01) |
| *A41D 13/05* | (2006.01) |
| *A41D 27/28* | (2006.01) |
| *A42B 1/08* | (2006.01) |

(52) U.S. Cl.

CPC ..... *A41D 13/018* (2013.01); *A41D 13/0155* (2013.01); *A41D 13/0158* (2013.01); *A42B 3/063* (2013.01); *A42B 3/122* (2013.01); *A63B 71/081* (2013.01); *A63B 71/10* (2013.01); *A41D 13/0518* (2013.01); *A41D 27/28* (2013.01); *A42B 1/08* (2013.01); *A63B 2209/00* (2013.01); *A63B 2220/13* (2013.01); *A63B 2220/801* (2013.01); *A63B 2220/833* (2013.01); *A63B 2220/89* (2013.01); *A63B 2225/62* (2013.01)

(58) Field of Classification Search

CPC ..... A41D 13/0158; A42B 3/121; A42B 3/12; A42B 3/10; A42B 3/122; A63B 71/081

See application file for complete search history.

(56) References Cited

U.S. PATENT DOCUMENTS

| | | | | |
|---|---|---|---|---|
| 2,194,903 A | | 3/1940 | Holstein | |
| 3,039,109 A | * | 6/1962 | Simpson | A42B 3/121 2/413 |
| 3,283,336 A | * | 11/1966 | Critser | A42B 3/20 2/9 |

(Continued)

*Primary Examiner* — Tajash D Patel

(57) ABSTRACT

Different safety gear for the head, face, and body are disclosed with an outer shell made of a flexible antiballistics material or aramid fiber based fabric, an inflatable chamber adjacent to or integrated into the outer shell, a valve coupled to the inflatable chamber, and energy absorbing structures. The inflatable chamber extends across the outer shell and provides a first layer protecting the wearer from impact energy. The inflatable chamber has an internal cavity that expands in response to injection of air or liquid through the valve. The energy absorbing structures provide a second layer supplementing the first layer of the inflatable chamber protecting the wearer from the impact energy. The energy absorbing structures are compressible bars, tubes, rods, or ribs or rubber or high-density polyurethane foam extending against the inflatable chamber and compressing in response to the impact energy transferring from the outer shell or the inflatable chamber.

7 Claims, 5 Drawing Sheets

(56) References Cited

U.S. PATENT DOCUMENTS 3,668,704 A * 6/1972 Conroy ..... A42B 3/122 2/413
3,713,640 A * 1/1973 Margan ..... A42B 3/122 267/117
3,994,022 A * 11/1976 Villari ..... A42B 3/121 2/909
4,121,904 A * 10/1978 Schamper ..... A61K 8/46 8/161
4,354,284 A * 10/1982 Gooding ..... A42B 3/121 2/413
5,647,066 A 7/1997 Joslin et al.
6,381,760 B1 * 5/2002 Lampe ..... A63B 71/10 2/418
6,493,881 B1 * 12/2002 Picotte ..... A42B 3/121 2/413
7,566,313 B1 * 7/2009 Argenta ..... A61F 5/05891 602/17
9,961,953 B1 * 5/2018 VanHoutin ..... A42B 3/328
11,234,474 B2 * 2/2022 Tephabock ..... A42B 3/12
2008/0256686 A1 * 10/2008 Ferrara ..... A41D 13/0155 2/413
2011/0271428 A1 * 11/2011 Withnall ..... A42B 3/20 2/422
2013/0125294 A1 5/2013 Ferrara
2013/0185837 A1 * 7/2013 Phipps ..... A42B 3/12 2/2.5
2014/0000012 A1 1/2014 Mustapha
2015/0135413 A1 * 5/2015 Mayerovitch ..... A42B 3/125 2/414
2015/0223547 A1 * 8/2015 Wibby ..... A42B 3/064 2/414
2015/0230533 A1 * 8/2015 Bancroft ..... A42B 3/20 2/424
2015/0268007 A1 * 9/2015 Bergman ..... F41H 5/0421 89/36.02
2016/0029730 A1 * 2/2016 Day ..... F16F 3/0873 2/412
2017/0303623 A1 * 10/2017 Sicking ..... A42B 3/064
2018/0228239 A1 * 8/2018 Day ..... F16F 1/126

* cited by examiner

SAFE AIR HEAD, FACE, AND BODY GEAR

CLAIM OF BENEFIT TO RELATED APPLICATIONS

This application is a continuation-in-part of U.S. nonprovisional application Ser. No. 13/815,510, entitled "Safe Air Head, Face, Body Gear", filed Mar. 7, 2013 which claims the benefit of U.S. provisional application 61/743,156 filed Aug. 27, 2012. The contents of application Ser. Nos. 13/815,510 and 61/743,156 are hereby incorporated by reference.

TECHNICAL FIELD

This invention relates to safety gear, specifically for the head, face, and body.

BACKGROUND ART

Safety gear is used in many sporting and recreational activities for protection of the head, face and body. For instance, cyclists as well as football, hockey, and baseball players all wear a helmet and various other padding or protective guards.

However, prior art safety gear is mostly inadequate, because wearers can still sustain minor to major trauma to the head, face, or body despite using the available gear. Some of these injuries are permanent, affect the quality of life, and cannot be repaired with modern day medicine.

The injuries are due to inadequate impact energy absorption and dampening. Prior art safety gear is primarily designed around providing a hard-outer shell that shields the wearer's soft tissue from direct impact. There is often a thin layer of internal padding between the hard-outer shell and the wearer's body. For instance, football helmets in widespread use have hard-outer shells. When there is head-to-head contact, it is the equivalent of smashing two marbles together. The hard-outer shells do not absorb any of the impact energy. Instead, the hard-outer shells transfer the energy to the wearer's head with just a thin layer of padding in between. This padding provides some energy absorption, but is simply inadequate to properly protect the wearer's head. Other safety gear, like shoulder and chest pads are also hard and rigid and do little in terms of absorbing or redirecting impact energy. The same issues manifest in the gear used presently for protection of the knee, shin/ankle, chest, and elbow. All such protective gear is comprised of a hard-outer shell such that the impact power received will not dissipate sufficiently to protect the wearer regardless if additional padding is provided between the hard-outer shell and wearer's body.

This patent application, with the use of simple technologies, provides a much safer form of safety gear, for the present and future. This application describes different materials along with the simple technologies to provide advanced and safer safety gear.

BRIEF DESCRIPTION OF THE DRAWINGS

Preferred embodiments for safe air head, face, and body gear will now be described, by way of example, with reference to the accompanying drawings in which.

DETAILED DESCRIPTION

Disclosed are different embodiments for sports and recreational activity safety gear. The embodiments disclose safety gear for the head, face, and body. The safety gear of the embodiments presented herein is manufactured from a variety of impenetrable and strong yet flexible and energy absorbing materials to differentiate from prior art safety gear that is predicated on the use of rigid and inflexible outer shells. Consequently, the outer shell of the safety gear embodiments disclosed herein provides an initial or first layer of dampening that is not present in prior art safety gear.

Figure 1A:
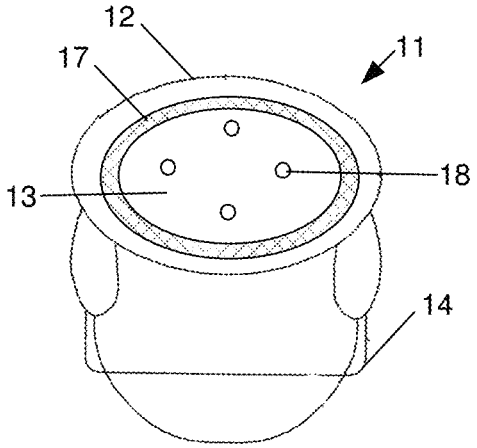
FIGS. 1A, 1B, and 1C provide different views of a safety helmet in accordance with some embodiments.
Figure 1B:
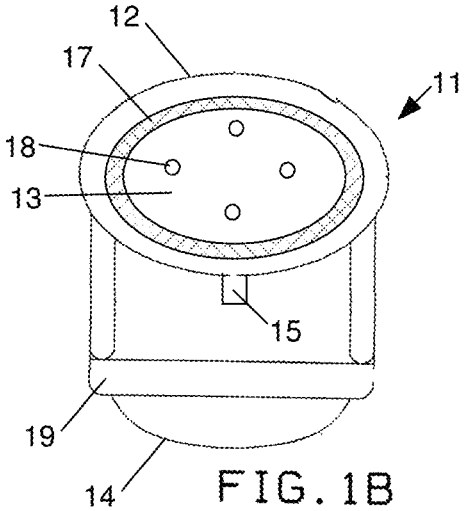
Figure 1C:
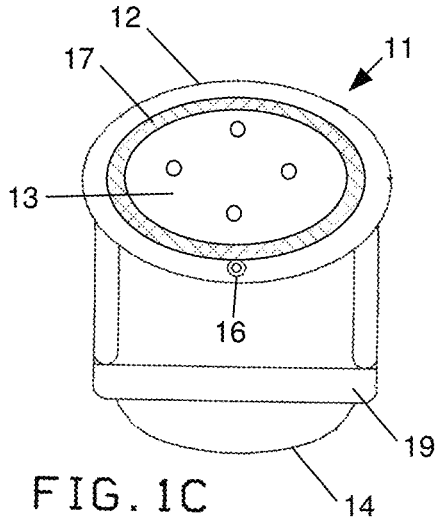

FIG. 1A provides a front view of a safety helmet 11 in accordance with some embodiments. FIGS. 1B and 1C provide rear views of the safety helmet 11 in accordance with some embodiments.

The safety helmet 11 comprises one or more of an inflatable outer chamber 12, an interchangeable or fixed cap 13, chin strap 14, energy absorbing structures 17, ventilation holes 18, and facemask 19.

The inflatable outer chamber 12 includes a top section and side sections. The top section surrounds or encircles the top of the wearer's head. In some embodiments, the top section has a dome shape to conform better to the shape of the wearer's head. In some embodiments, the height or length for the top section of the inflatable chamber 12 ranges between the top of the wearer's head to the wearer's eyeline depending on the sporting or recreational activity and the amount of protection needed. The side sections extend downward from the top section and protect the sides of the head from impact.

The inflatable outer chamber 12 is formed from an impenetrable and strong yet flexible material. In some embodiments, the inflatable outer chamber 12 material is rubber, Kevlar® fabric, carbon composite fabrics, antiballistic fabrics, Vectran® fiber fabrics, Twaron fabrics, Alkex fabrics, graphene based fabrics, or other aramid fabrics. Several layers of these materials can be used in creating the inflatable outer chamber 12. The materials are layered or manufactured in such a way so as to form an air-tight seal or balloon that is either cylindrical, rectangular, or other regular or irregular shapes.

The inflatable outer chamber 12 can be inflated and filled with air or fluid. FIG. 1B illustrates an air valve 15 into which air can be blown to inflate the inflatable outer chamber 12. FIG. 1C illustrates an alternative construction whereby the air valve is replaced with an inflation needle valve 16. Various air pumps or air compressors with an inflation needle can be used to inflate the inflatable outer chamber 12. Air pumps or air compressors are preferred as they can inflate the inflatable outer chamber 12 to a specified pounds per square inch (PSI) of pressure. Depending on thickness of the inflatable outer chamber 12 material and desired application of the helmet 11, the outer chamber 12 can support air pressures as low as 10 pounds per square inch (PSI) for low impact applications (e.g., hiking), and as high as 100 PSI for high impact applications (e.g., football, cycling, hockey, boxing, construction, etc.).

Regardless of the PSI, the inflatable outer chamber 12 remains flexible and bends to absorb and dampen impact energy. The flexibility of the inflatable outer chamber 12 material as well as the air inside act as shock absorbers against impact energy placed on the helmet 11 exterior. In particular, the inflatable outer chamber 12 will be bend to absorb some of the impact energy with the air inside the chamber 12 providing a separation cushion against the impact.

To improve upon the energy absorbing properties of the helmet, some embodiments include the energy absorbing structures 17 within the inflatable outer chamber 12. In some embodiments, the energy absorbing structures 17 are attached to the side of the inflatable outer chamber 12 that is closest to the wearer head or body.

The energy absorbing structures 17 can be comprised of bars, tubes, rods, or ribs made of compressible rubber or high-density polyurethane foam. Each individual structure of the energy absorbing structures 17 is adapted to compress or bend in response to an application of force. The energy absorbing structures 17 act similar to a crumple zone of an automobile by crumpling or compressing to reduce impact energy that transfers to the head of the individual wearing the helmet. However, the energy absorbing structures 17 revert to their original form when the impact force causing their compression is removed. The thickness of the energy absorbing structures 17 can vary depending on the application. The structures 17 will be thicker in order to compress under higher amounts of force and thinner in order to compress under lower amounts of force. The energy absorbing structures 17 can be aligned in parallel or in some lattice or interlaced pattern that increases energy absorption properties of the energy absorbing structures 17. The structures 17 can also be angled from the wearer's head so that any energy that cannot be absorbed is redirected from having a direct impact on the wearer's head.

The energy absorbing structures 17 work in concert with the inflatable outer chamber 12 to absorb and dampen impact energy. In particular, the inflatable outer chamber 12 acts as a first layer of protection. Impact energy that transfers into the inflatable outer chamber 12 will be then met with the energy absorbing structure 17 which act as a second layer of protection to absorb and dampen the transfer impact energy.

In some embodiments, the energy absorbing structures 17 are separated from the inflatable outer chamber 12. In some such embodiments, the energy absorbing structures 17 are disposed about an exterior of the inflatable outer chamber 12. In some other such embodiments, the energy absorbing structures 17 are disposed between the inflatable outer chamber 12 and the wearer's head.

As noted above, the helmet 11 includes an interchangeable or fixed cap 13. The interchangeable cap 13 can be used to adapt the helmet 11 for different applications or activities. For instance, a first cap 13 can be coupled to the helmet when used for a first sporting activity and a second cap 13 can be coupled to the helmet when used for a different second sporting activity. Additionally, the interchangeable cap 13 allows for simple customizability of the helmet 11. For instance, different caps 13 can be placed on the helmet 11 to differentiate when the wearer is participating on different teams.

In some embodiments, the cap 13 includes various ventilation holes 18. The ventilation holes 18 permit air to enter the helmet 11 and remove heat from the head. The ventilation holes 18 can be circular apertures about the cap 13. The ventilation holes 18 can be of various sizes and shapes depending on the helmet 11 application.

The helmet 11 has an optional chin strap 14. When secured to the helmet 11, the chin strap 14 holds the helmet 11 in place and prevents the helmet 11 from falling off the wearer upon impact.

Depending on the application, the helmet 11 optionally includes a facemask 19. The facemask 19 can be an extension of the inflatable outer chamber 12. Alternatively, the facemask 19 can be a second inflatable outer chamber that is made of the same impenetrable and strong but flexible material as the inflatable outer chamber 12. However, the facemask 19 is formed so as to not block the wearer's view while still protecting the eyes, nose, and mouth area of the wearer from impact. As can be seen in FIGS. 1B and 1C, the facemask 19 also extends behind the wearer's head to protect against rear impact.

Figure 2A:
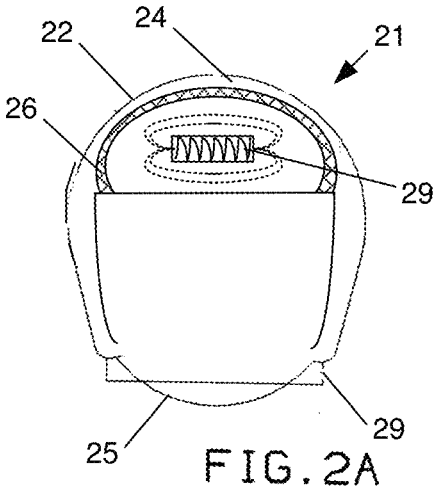
FIGS. 2A, 2B, and 2C provide different views of an alternative safety helmet in accordance with some embodiments.
Figure 2B:
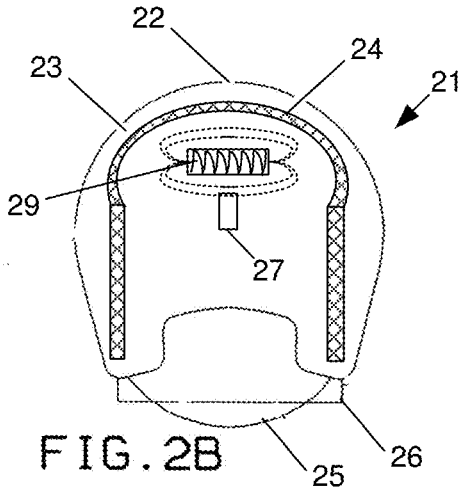
Figure 2C:
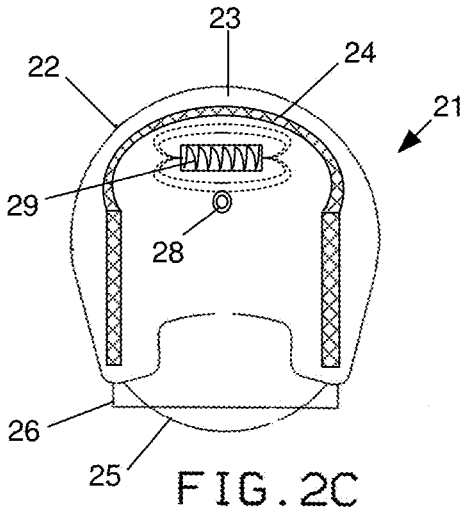

Further safety improvements can be made to the safety helmet of FIGS. 1A-1C. FIGS. 2A, 2B, and 2C illustrate a safety helmet 21 with magnetic impact avoidance in accordance with some embodiments. FIG. 2A provides a front view of the helmet 21 in accordance with some embodiment. FIGS. 2B and 2C provide alternate rear views for the helmet 21 in accordance with some embodiments.

The helmet 21 has an outer shell 22 with a more traditional shape in the form of the wearer's head. The outer shell 22, however, differs from the hard and rigid outer shells of prior art helmets. The helmet 21 of some embodiments has an outer shell 22 made of an impenetrable and strong yet flexible material. This can be the same material as the material for the inflatable outer chamber 12 in FIGS. 1A-1C. More specifically, the outer shell 22 of helmet 21 is made of one or more layers of rubber, Kevlar® fabric, carbon composite fabrics, antiballistic fabrics, Vectran® fiber fabrics, Twaron fabrics, Alkex fabrics, graphene based fabrics, or other aramid fabrics. These materials are often used for antiballistic or bulletproof vests. The materials flex in order to absorb a very high impact, such as a gunshot, without tearing or being penetrated. Multiple layers of the material can form the outer shell 22 to increase rigidity and energy absorption properties depending on the helmet 21 application.

Underneath the outer shell 22 is at least one inflatable chamber 23. The at least one inflatable chamber 23 can be a single unitary structure with a dome shape mirroring the shape of the of the outer shell 22. Alternatively, the at least one inflatable chamber 23 can comprise a set of cylindrical tubes or square or rectangular pads, each with an internal cavity that expands in response to injection of air or liquid. In some embodiments, the inflatable chamber 23 further includes side extensions that protect the sides of the wearer's face. In particular, the side extensions extend downwards over the wearer's cheeks and jaw. The inflatable chamber 23 can be made of the same strong impenetrable but flexible material as the shell 22. Alternatively, the inflatable chamber 23 can be made of plastic, silicon, or other softer materials since the inflatable chamber 23 is now protected by the outer shell 22. The inflatable chamber 23 can be filled with air or fluid (i.e., liquid) to provide a cushion for absorbing impact energy.

Once again, the energy absorbing structures 24 can be disposed within the inflatable chamber 23, between the inflatable chamber 23 and the wearer's head, or between the inflatable chamber 23 and the outer shell 22. The energy absorbing structures 24 supplement the energy absorption and dampening provided by the outer shell 22 and the inflatable chamber 23. FIG. 2B illustrates an air valve 27 and FIG. 2C illustrates an inflation needle valve 28 with which to inject air into the inflatable chamber 23.

The helmet 21 includes the optional chin strap 25 and facemask 26 for different applications.

To further enhance the safety of the helmet 21, some embodiments dispose at least one electromagnet 29 within the helmet 21. In some embodiments, the at least one electromagnet 29 is a magnetic coil that runs across the surface of the helmet 21. In some other embodiments, the helmet 21 comprises a set of magnetic coils that are equally distributed about the surface of the helmet 21. The one or more electromagnets 29 can be disposed about the exterior of the helmet 21 with hard protective coverings to prevent damage to the electromagnetics upon impact. The one or more electromagnets 29 can also be disposed inside the helmet 21 between the outer shell 22 and the inflatable chamber 23 or between the inflatable chamber 23 and the energy absorbing structures 24. The electromagnets 29 are wired to a power source (not shown). The power source can be a battery that is integrated into the helmet 21. Alternatively, the power source can be located off the helmet 21 with wiring connecting the electromagnets 29 to the power source.

The at least one electromagnet 29 produces a strong magnetic field with a particular polarity in response to receiving power from the power source. The magnetic field with the same particular polarity is produced by the electromagnets 29 of different helmets. Accordingly, as two helmets 21 near for contact, the magnetic fields produced by each helmet 21 repel one another. This in turn lessens the impact between the two helmets 21 should they collide The electromagnets 29, if continually powered, can quickly deplete the power source. Accordingly, some embodiments place a proximity sensor (not shown) on the helmet 21 to control when the electromagnets 29 are powered on and off. The proximity sensor is an extremely low power device that is also coupled to the power source and the electromagnets 29. The proximity sensor detects when another helmet or other object is within a certain distance. In response to the proximity sensor detecting an object, the proximity sensor supplies power from the power source to the at least one electromagnet 29, thereby producing the magnetic repulsion force for added protection. When the object is no longer detected, the proximity sensor cuts power to the at least one electromagnet 29 which eliminates the magnetic repulsion force, but saves power. Some embodiments deploy a proximity sensor to the front and rear of the helmet, each with a 180 degree detection range.

Figure 3:
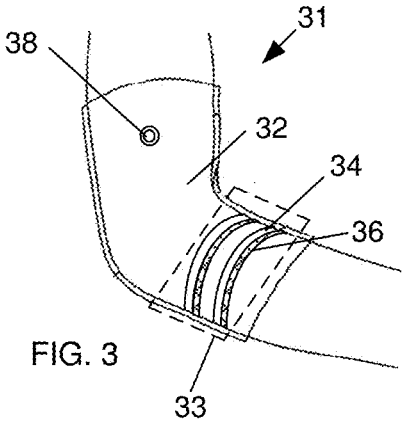
FIG. 3 illustrates a safety sleeve that is a protective covering for the elbow in accordance with some embodiments.

FIG. 3 illustrates a safety sleeve 31 in accordance with some embodiments. In FIG. 3, the safety sleeve 31 is a protective covering for the elbow. The safety sleeve 31 is tubular in shape. The outer shell 32 of the safety sleeve 31 is made of the same strong and impenetrable yet flexible material as the helmets described above. In some embodiments, the safety sleeve 31 outer shell is made of rubber, Kevlar® fabric, carbon composite fabrics, antiballistic fabrics, Vectran® fiber fabrics, Twaron fabrics, Alkex fabrics, graphene based fabrics, or other aramid fabrics. These materials allow the safety sleeve 31 to remain flexible so as to not overly constrain user movement while still providing protection against impact.

As shown in the cutaway view 33, the safety sleeve 31 includes at least one inflatable chamber 34 for increased protection against impact. The at least one inflatable chamber 34 can be embedded within the outer shell 32 or separately attached to the exterior or interior of the outer shell 32. The inflatable chamber 34 supplements the protection provided by the outer shell 32 by providing impact energy dampening by flexing and displacing the inflated air upon impact by an external force.

The at least one inflatable chamber 34 is disposed perpendicular to the sleeve 31 openings. As shown in FIG. 3, the at least one inflatable chamber 34 comprises one or more concentric inflatable rings. In some embodiments, each chamber 34 can be inflated separately so as to customize where the added protection is provided without compromising mobility. Alternatively, the at least one inflatable chamber 34 can comprise a set of square or rectangular pads that each have an internal cavity that expands in response to injection of air or liquid. One or more air valves or needle valves 38 are provided to inject air into the one or more inflatable chambers.

FIG. 3 further illustrates each inflatable chamber 34 incorporating the compressible energy absorbing structures 36 comprising bars, tubes, rods, or ribs made of compressible rubber or high-density polyurethane foam. The energy absorbing structures 36 are located below each chamber 34 so as to provide additional impact energy absorption and dampening. The energy absorbing structures 36 can also be placed above the chamber 34. The energy absorbing structures 36 can be aligned in parallel or in a lattice or interlaced pattern.

Figure 4:
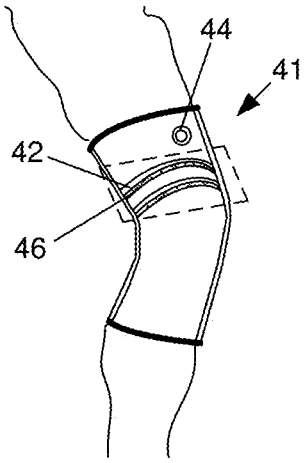
FIG. 4 illustrates a safety sleeve that is a protective covering for the knee in accordance with some embodiments.
Figure 5:
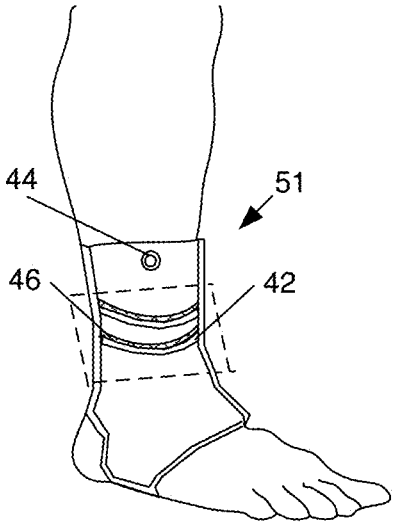
FIG. 5 illustrates a safety sleeve that is a protective covering for the shin in accordance with some embodiments.

In FIG. 4, the safety sleeve 41 is a protective covering for the knee and in FIG. 5, the safety sleeve 51 is a protective covering for the shin. The safety sleeve can additional applications for protecting other areas of the human body.

In all such applications including those illustrated in FIG. 4 and FIG. 5, the safety sleeves (e.g., 41 and 51) is tubular and made of the strong and impenetrable yet flexible material such as rubber, Kevlar® fabric, carbon composite fabrics, antiballistic fabrics, Vectran® fiber fabrics, Twaron fabrics, Alkex fabrics, graphene based fabrics, or other aramid fabrics. The safety sleeves include at least one inflatable chamber 42 surrounding the protecting body part, one or more air valves or needle valves 44 to inject air into the one or more inflatable chambers 42, and compressible energy absorbing structures 46 to supplement the energy dampening provided by the at least one inflatable chamber 42.

Figure 6:
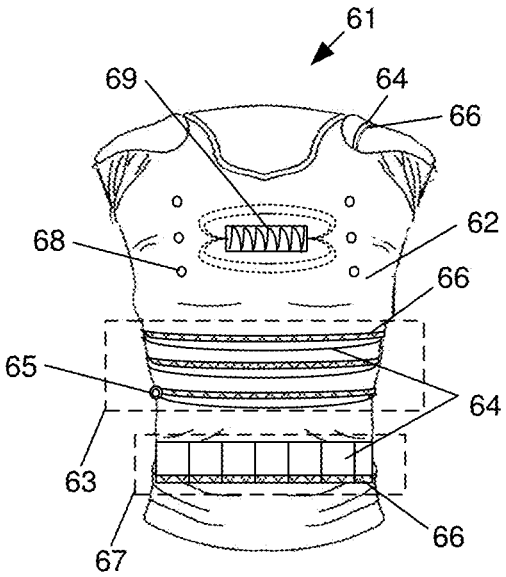
FIG. 6 illustrates a safety vest in accordance with some embodiments.

FIG. 6 illustrates a safety vest 61 in accordance with some embodiments. The safety vest protects the shoulders, chest, and back from impact.

Here again, the outer shell 62 of the safety vest 61 is made of the strong and impenetrable but flexible materials enumerated above. In some embodiments, the outer shell 62 is manufactured to include at least one inflatable chamber 64. In some other embodiments, the at least one inflatable chamber 64 is attached to the exterior or interior of the outer shell 62.

The cutaway view 63 illustrates the at least one inflatable chamber 64 as a set of inflatable chambers 64 aligned laterally and in parallel from top to the bottom of the vest. The cutaway view 67 illustrates the at least one inflatable chamber as a set of inflatable pads with an interval cavity that expands in response to injection of air or gas. Each of the chambers 64 can be separately inflated to customize comfort and mobility of the wearer. Alternatively, the chambers 64 can be connected to inflate and deflate together. In some other embodiments, the inflatable chambers 64 are aligned longitudinally and in parallel from right to left of the vest. In still some other embodiments, the inflatable chambers 64 have an interlaced pattern. One or more air valves or needle valves 65 are provided to inject air into the one or more inflatable chambers 64.

In any such configuration, the one or more inflatable chambers 64 work with the outer shell 62 to absorb and dampen impact energy. The inflatable chambers 64 cushion the wearer's body from impact by compressing to absorb the impact energy and by redirecting the impact energy around the body rather than directly through to the body.

As with the embodiments above, the inflatable chambers 64 of the safety vest 61 optionally include energy absorbing structures 66 to aid in the impact energy absorption. Here again, bars, tubes, rods, or ribs made of compressible rubber or high-density polyurethane foam line the inflatable chamber 64. The energy absorbing structures 66 compress in order to absorb excess impact forces or energy that push against the inflatable chamber 64.

Inflatable chambers 64 and energy absorbing structures 66 are also disposed over the shoulder area to protect the shoulder from impact. In some embodiments, these protective structures for the shoulder area are semi-circular.

Various ventilation holes 68 are provided across the vest 61. The ventilation holes 68 improve breathability of the vest 61 and allow heat from wearer's body to escape.

In some embodiments, the safety vest 61 further includes one or more electromagnets or magnetic coils 69 and a power source (not shown). The magnetic coils 69 can criss-cross across the vest 61 or different magnetic coils 69 can be distributed to one or more of the front, back, sides of the vest 61. The magnetic coils 69 draw power from the power source in order to create a magnetic field of a particular polarity. When another vest 61 or helmet generating a magnetic field of the same particular polarity comes in range, the magnetic fields repel one another, thereby creating an opposing force to mitigate the impact force.

The safety vest 61 is illustrated as a sleeveless vest. Other embodiments can include short or full length sleeves to protect the wearer's arms. The outer shell of the sleeves would be formed of the same material as the vest 61 and would further include one or more inflatable chambers 64 and energy absorbing structures 66 for added energy absorption.

In some embodiments, a neck protective covering is provided to cover the gap between the safety vest 61 and a helmet worn by a human. In some such embodiments, the neck protective covering attaches to the back top end of the safety vest 61 and also connects to the back bottom end of the helmet with a securing mechanism such as press buttons. The neck protective covering is made of the same strong and impenetrable yet flexible material as the other safety gear. As noted, any of the antiballistics, graphene, or aramid fabrics are flexible so as to not restrict the user's head movements. The inflatable chamber and energy absorbing structures aligning the neck protective covering do however provide protection of the user's neck.

Figure 7:
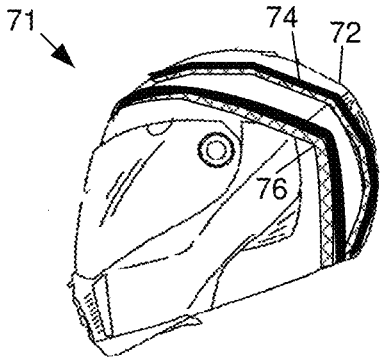
FIG. 7 illustrates a motorcycle helmet in accordance with some embodiments.

FIG. 7 illustrates a motorcycle helmet 71 in accordance with some embodiments. Unlike traditional motorcycle helmets that have a hard-outer shell, the outer shell 72 of the motorcycle helmet 71 is made of the strong and impenetrable but flexible materials enumerated above. In particular, the helmet outer shell 72 is made of one or more of rubber, Kevlar® fabric, carbon composite fabrics, antiballistic fabrics, Vectran® fiber fabrics, Twaron fabrics, Alkex fabrics, graphene based fabrics, or other aramid fabrics. The shape of the helmet 71 is supported by an internal inflatable chamber 74. In some embodiments, the internal inflatable chamber 54 is made of the same material as the outer shell 72. Energy absorbing structures 76 may be integrated within or around the internal inflatable chamber 74 for added impact energy absorption.

Figure 8:
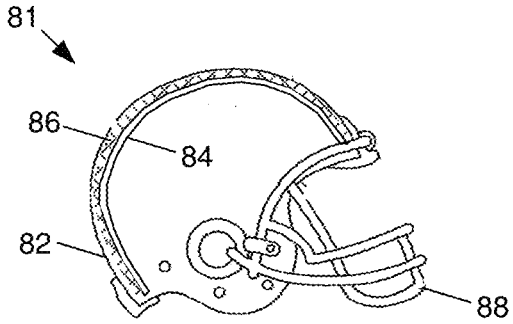
FIG. 8 illustrates a specific implementation of the safety helmet of some embodiments as a football helmet.

FIG. 8 illustrates a specific implementation of the safety helmet of some embodiments as a football helmet 81. As with the motorcycle helmet 71 of FIG. 7, the football helmet 81 of FIG. 8 substitutes the hard-outer shell of traditional football helmets with the strong and impenetrable but flexible materials enumerated above. Underneath the outer shell 82 is an inflatable chamber 84. Energy absorbing structures 86 described above are also integrated within or around the inflatable chamber 84.

Figure 9:
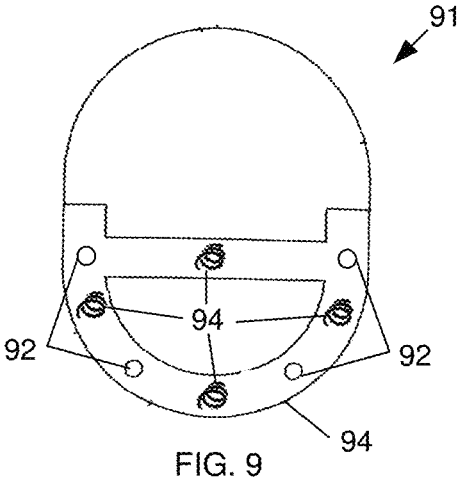
FIG. 9 illustrates a football helmet of some embodiments with a facemask attachment extension including a set of female fittings to attach to complimentary male fittings of a facemask, and impact absorbing structures dampening impact energy from an attached facemask.
Figure 10:
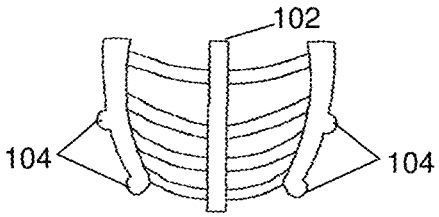
FIG. 10 illustrates the separated facemask with a set of male fittings coupling to the set of female fittings of the football helmet from FIG. 9 in accordance with some embodiments.

FIG. 9 and FIG. 10 illustrate a modified football helmet 91 with a detachable facemask 102 in accordance with some embodiments. The football helmet 91 is made of the same materials and includes the same structures as the football helmet 81 of FIG. 8 except that the helmet 91 includes an impact absorbing and detachable facemask 102 that is detachable from the helmet 91.

An impact absorbing and detachable facemask 102 is desired for a variety of reasons. One reason is for quick adaptation of the helmet 91. The same helmet 91 can be worn for different sporting or recreational activities. Another reason is for energy absorption. A fixed facemask will direct all impact energy to the helmet. A detachable facemask 102 can act like a crumple-zone of an automobile and absorb impact energy by flexing or compressing and ultimately detaching so as to prevent the energy transfer through to the helmet 91. A detachable facemask 102 also prevents injuries that result when one's head and neck is contorted as a result of another grabbing and pulling the facemask 102.

As shown in FIG. 10, the facemask 102 can be separated from the helmet 91 and includes a set of male fittings 104. FIG. 9 illustrates a complimentary set of female fittings 92 on the helmet 91. The set of female fittings 92 are disposed about an extension 94 from the bottom of the helmet 91. The extension 94 can be at an angle or vertical. The set of male fittings 104 from the facemask 102 couple to the set of female fittings 92 on the helmet 91 in order to attach the facemask 102 to the helmet 91. In some embodiments, the facemask 102 couples to the helmet 91 with a set of press buttons, although other fastening mechanisms can be alternatively used.

A set of dampeners or shock absorbers 96 is juxtaposed or placed adjacent to the set of female fittings 92 and/or male fittings 104. The set of dampeners 96 absorb impact energy from the facemask 102, thereby preventing the absorbed energy from transferring to the helmet 91. The set of dampeners 96 can include springs or bars, tubes, rods, or ribs made of compressible rubber or high-density polyurethane foam as some examples.

The disclosed embodiments have several advantages over safety gear of the prior art including:

(a) The strong and impenetrable yet flexible exterior or outer shell of the gear will cause less injuries and fewer long term injuries.

(b) Lighter weight safety gear.

(c) The detachable facemask reduces chances of injuries from the present day style of fixed facemasks that can be grabbed resulting in contortions of the head and neck.

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

I claim:

1. A safety impact absorbing helmet comprising: an inflatable outer chamber made of soft flexible KEVLAR or graphene based fabrics conforming about the head;

the inflatable outer chamber includes an adjustable valve to add or decrease air therein;

energy absorbing structures including a plurality of compressible bars, tubes, rods or ribs being positioned within the inflatable outer chamber or positioned adjacent to an inner surface of the inflatable outer chamber;

a detachable facemask having a plurality of male fittings being attached to a plurality of female fittings on the helmet, respectively; and a plurality of biased dampeners being positioned adjacent to the plurality of male and female fittings to partially absorb impact energy.

2. The safety helmet of claim 1, wherein the plurality of compressible bars, tubes, rods, or ribs-extend vertically from the inflatable outer chamber and are arranged in parallel or in an interlaced pattern.

3. The safety helmet of claim 1, wherein the plurality of compressible bars, tubes, rods, or ribs are interlaced and extend an angle from the inflatable chamber.

4. The safety helmet of claim 3, wherein the plurality of biased dampeners comprise springs providing partial absorption of the impact energy applied to the detachable facemask when the plurality of male fittings are attached to the plurality of female fittings.

5. The safety helmet of claim 1, wherein one or more of the plurality of male and female fittings correspond to a set of press buttons.

6. The safety helmet of claim 1, wherein the detachable facemask has a crumple-zone providing flex or compression in response to impact energy thereon to substantially detach facemask from the helmet.

7. The safety helmet of claim 1, wherein the inflatable outer chamber has an adjustable chin strap.

* * * * *